US005961293A

United States Patent [19]

Clemmons et al.

[11] Patent Number: 5,961,293

[45] Date of Patent: Oct. 5, 1999

[54] IN-TAKE FUEL PUMP ASSEMBLY WITH UNITARY CONTROL UNIT FOR INTERNAL COMBUSTION ENGINES

[75] Inventors: Robert T. Clemmons; Ralph E. Ulm, both of Fairfield, Ill.

[73] Assignee: UIS, Inc, New York, N.Y.

[21] Appl. No.: 08/681,738

[22] Filed: Jul. 29, 1996

Related U.S. Application Data

[63] Continuation-in-part of application No. 08/444,413, May 19, 1995.

[51] Int. Cl.[6] ..... F04B 49/06; F04B 35/04

[52] U.S. Cl. ..... 417/44.2; 417/44.9; 417/423.3; 417/423.14; 417/410.4

[58] Field of Search ..... 417/44.2, 44.9, 417/423.3, 423 R, 423.13, 423.14, 424.1, 410.3, 410.4

[56] References Cited

U.S. PATENT DOCUMENTS

| | | | |
|---|---|---|---|
| 4,756,291 | 7/1988 | Cummins | 123/497 |
| 4,775,917 | 10/1988 | Eichhorn et al. | 361/388 |
| 4,904,162 | 2/1990 | Suzuki et al. | 417/410.3 |
| 4,926,829 | 5/1990 | Tuckey | 123/497 |
| 5,040,954 | 8/1991 | Iwai | 417/423.12 |
| 5,055,758 | 10/1991 | Hock | 318/645 |
| 5,411,376 | 5/1995 | Fournier et al. | 417/410.4 |
| 5,454,697 | 10/1995 | Nakanishi | 417/423.3 |
| 5,593,287 | 1/1997 | Sadakata et al. | 417/423.14 |

FOREIGN PATENT DOCUMENTS

| | | |
|---|---|---|
| 56088982 | 7/1981 | Japan . |
| 62267564 | 5/1986 | Japan . |
| 05071436 | 3/1993 | Japan . |
| WO 96/10693 | 4/1996 | WIPO . |
| WO 98/04824 | 2/1998 | WIPO . |

*Primary Examiner*—Charles G. Freay
*Attorney, Agent, or Firm*—Andrus, Sceales, Starke & Sawall

[57] ABSTRACT

An in-tank fuel pump apparatus includes an elongated motor-pump unit having a motor and pump unit connected in end-to-end relation. An outer cam has a substantially constant diameter enclosing the motor-pump unit and projecting axially outwardly therefrom and defining a control chamber immediately adjacent the one end of the motor-pump unit. A control tower is secured to the end of the motor-pump unit from which the motor cam extends. The control tower includes a body member having a closure plate abutting the motor pump unit, an outlet passageway extending axially from the motor-pump unit to the exterior of the motor cam, a pressure sensor secured within the body member having an inlet connected to a sensing passage connected to the output of the motor pump unit in an outermost circuit board forming the outermost end of the tower unit. An epoxy resin fills the unit about the several elements between the motor and the outer end of the cam and includes all voids within the tower structure to seal the control components against fuel and support the components as a single unitary assembly above the motor-pump unit. The tower is separately assembled as formed as a separate self-contained sub-assembly mounted within the outer housing and then with an epoxy resin introduced to fill the cavity and support all of the control, power and sensing components as a unitary complete control unit and outlet passage from the motor unit.

23 Claims, 5 Drawing Sheets

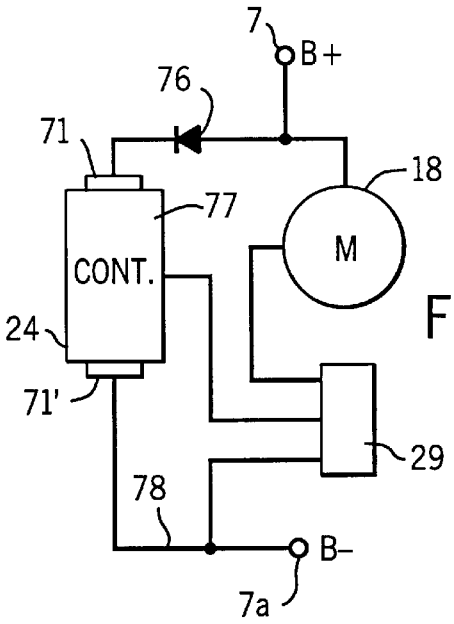
FIG. 9
FIG. 10
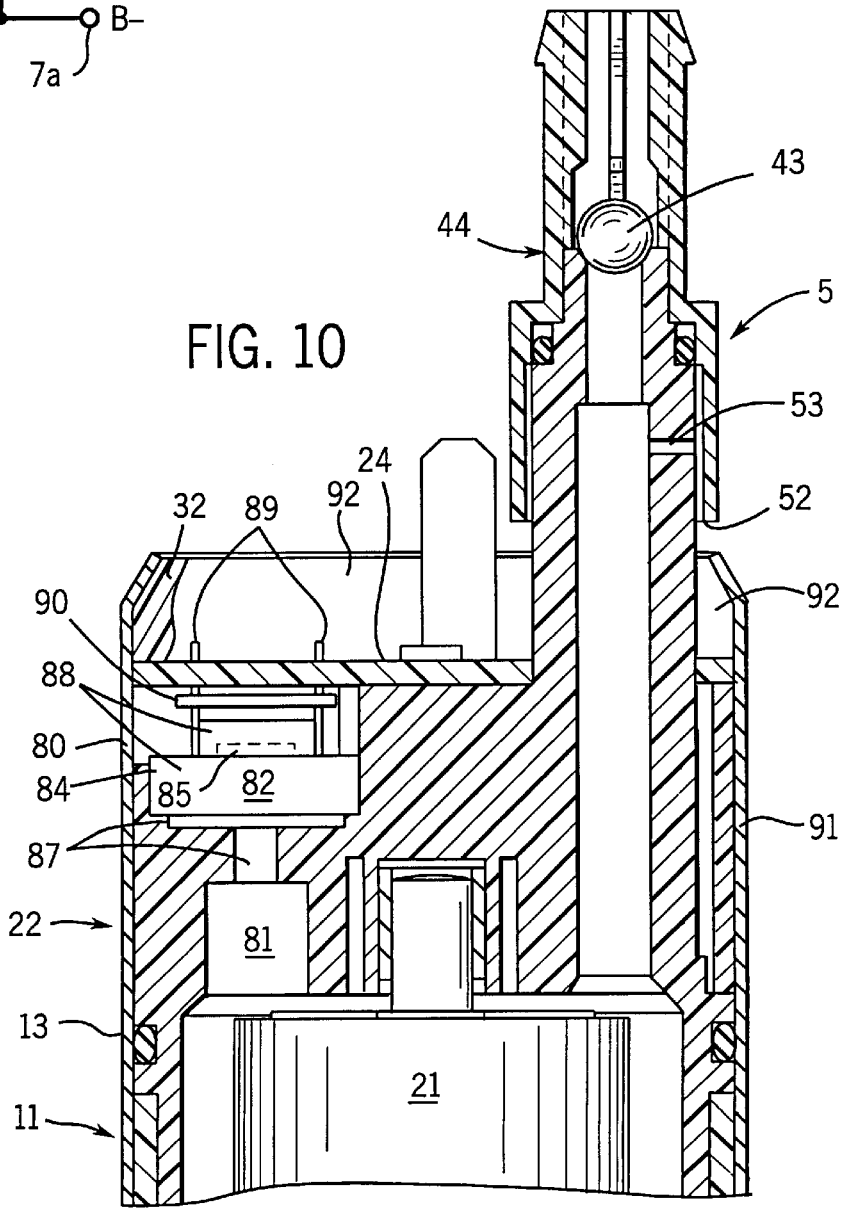

IN-TAKE FUEL PUMP ASSEMBLY WITH UNITARY CONTROL UNIT FOR INTERNAL COMBUSTION ENGINES

This application is a continuation-in-part of the inventors' pending application entitled "Motor Driven Fuel Pump And Control System For Internal Combustion Engines" filed on May 19, 1995 with Ser. No. 08/444,413, pending.

BACKGROUND OF THE INVENTION

This invention relates to an in-tank fuel pump assembly with an attached unitary control unit for supplying fuel to an internal combustion engine and particularly to the construction and mounting of a control unit to the motor-pump unit.

The above pending application discloses a particularly advantageous motor-driven fuel pump apparatus which is adapted for in-tank mounting as well as external in-line mounting to the fuel system, and particularly discloses both a preferred in-tank mounting construction as well a particular control circuit to supply fuel at an essentially constant pressure to the engine. The current prior art of fuel systems is disclosed and discussed in detail in the pending application. The apparatus and circuit disclosed in the pending application provides a particularly satisfactory and novel motor-driven pump unit for internal combustion engines.

The parent pending application particularly discloses a motor-pump unit having an elongated motor-pump unit including an outlet end frame incorporating the outlet passageways as well as a small circulating bleed passageway. A separate control unit is attached to the side of the motor-pump unit with a portion overlying the outlet end frame. The control unit includes a pressure sensor coupled to a sensing passageway in the outlet end frame and directly senses the outlet pressure of the pump unit. As set forth therein, there is a continuing demand in the industry for cost effective constructions, and particularly for in-tank fuel pump assemblies.

In summary, although various physical structural fuel pump devices have been provided for in-tank and external mounting, there is a continuous demand for alternative constructions which provide a compact assembly for convenient and inexpensive mounting within a fuel tank. A control unit which is secured to and forms a unitary part of the motor-pump unit for mounting directly within the fuel tank is also a significant factor in the design of an optimal fuel pump assembly.

SUMMARY OF THE PRESENT INVENTION

The present invention is particularly directed to a fuel pump assembly having a particular construction of a pressure responsive control unit mounted as a unitary part of the end frame structure of motor-pump unit. The unitary control unit forms an outward, aligned projection of the motor-pump unit to form an elongated tubular assembly for in-tank mounting. In a preferred particular structure, the one end frame structure is integrally formed with a control unit body member which includes the pump outlet tube and a pressure sensor secured within the body member and a control circuit board secured to the body member.

In a preferred embodiment of the invention, a single outer tubular can or shell encloses the motor-pump unit and the end frame units to form a single elongated tubular assembly with a fuel inlet unit secured to one end and an outlet unit at the opposite end. The outlet unit includes a unitary control tower unit having an integral end frame plate secured to the motor frame. The tower unit includes an outlet passageway or pipe coupled to the output of the motor-pump unit and projects outwardly of the outermost end of the fuel pump assembly. A pair of motor power channels are provided in the tower unit for motor brush units coupled to the motor and connected to motor power terminals. In addition, the tower unit includes a sensing passageway coupled to the pump outlet and a pressure sensor within the tower and coupled to the passageway and extending therefrom. In one embodiment, the sensor extends laterally outwardly and in a second sensor, extends axially outwardly. The sensor is sealed within the outer diameter of the control tower unit. A heat transfer shield or member extends about the control chamber and extends outwardly of the end frame plate. The heat transfer member preferably has an opening aligned with the pressure transducer and a flat surface formed on the inner wall, generally opposite the sensor, to receive a solid state power switch which is secured in insulated abutment with the inner wall. A control circuit board is secured abutting the upper or outer edge of the heat transfer member and is preferably secured in place by the power terminal units secured within the tower. The circuit board connects a power supply, the sensor, the power switch and the motor power terminals. The total assembly is secured in place within the outer shell extending over the exterior of the motor-pump unit and the tower unit with the shell secured to the fuel supply assembly to form a single elongated tubular motor/pump assembly and apparatus for fuel in-tank mounting. The shell or can about the tower unit is filled with a suitable encapsulating material to effectively seal the sensor and control system within the shell with the outlet tube and the power supply input terminals projecting outwardly of the material and the shell for appropriate power and fuel outlet interconnection. The filler material is preferably an epoxy resin or like material which will firmly interconnect the assembly to form a single self-supporting device adapted to be mounted within the fuel in the tank.

In a particularly practical embodiment, the total tower assembly preferably consists of a simple plastic molded housing built to receive the sensing unit, the motor brushes and the outlet passageway. The power terminals are assembled with the power contacts on the board and with the sensor secured within the tower body with appropriate terminals projecting upwardly and outwardly of the motor-pump and generally outwardly to the level of the incoming motor power terminals. The incoming power terminals are secured to the circuit board and project upwardly and outwardly of the outer shell or can. The upper end of the terminals project from the sealed connection of the tower within the can which is filled with suitable epoxy resin or other material to totally encapsulate the control and power circuitry confined within the towering circuit board and the outer can.

The opposite end of the motor is provided with a suitable, preferably molded pump inlet and pump unit, which is secured in abutting relation to the motor for drawing of the fuel inwardly and through the motor and discharging it through the outlet passageway pipe as well as for providing for supply pressurized fuel to the sensing chamber. In addition, the output tube has a small lateral by-pass passageway discharging of the fluid fuel directly into the tank to prevent vapor lock of the motor pump assembly. The outer end of the outlet passageway is preferably formed to receive an outlet coupler which is adapted to be telescoped over the outer end of the tube with a suitable releasable lock.

The present invention thus provides for a compact, minimum component control assembly adapted to be secured to the end of the motor-pump unit and projecting therefrom substantially within the confines of the outer diameter or configuration of the motor unit for simultaneous enclosure within a single can or other suitable housing or enclosure. The present invention further provides a readily constructed assembly with the several elements mounted in a very efficient and effective arrangement for an in-tank fuel assembly.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings:

FIG. 9 is a diagrammatical circuit of the motor and control unit of the fuel supply system; and FIG. 10 is a view similar to FIG. 5 of a second embodiment.

DESCRIPTION OF THE ILLUSTRATED EMBODIMENT

Figure 1:
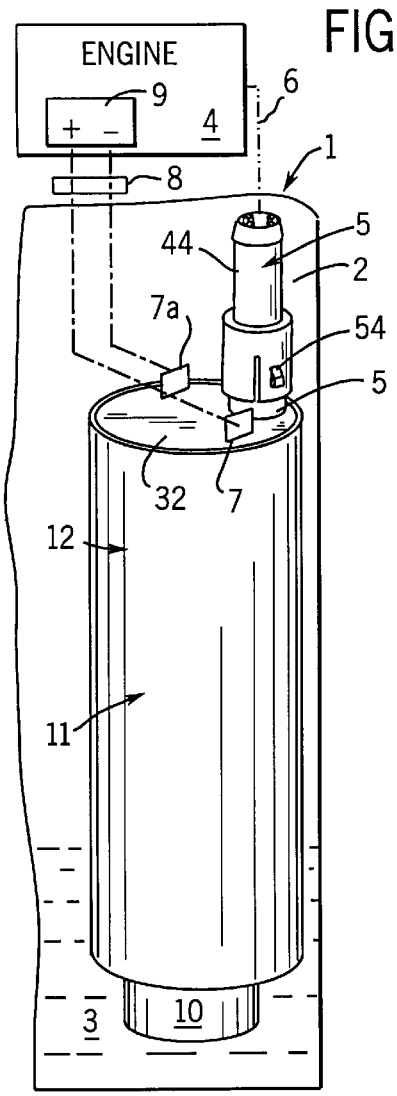
FIG. 1 is a side elevational view of a fuel supply system including a modular motor-pump unit and a control unit for in-tank mounting for supplying of fuel under pressure to an internal combustion engine.

Referring to the drawings and particularly to FIG. 1, a fuel supply assembly 1 is illustrated located in a fuel tank 2 for pumping of fuel 3 to an internal combustion engine 4. The fuel supply assembly 1 includes an outlet pipe 5 connected by a line 6 to the engine combustion system. The upper end of the assembly 1 includes power supply terminals 7 and 7*a* interconnected via a cable 8 to the electric power system of the engine, such as the battery 9.

The opposite end of the fuel supply assembly 1 includes an inlet unit 10 through which fuel 3 flows into the fuel supply assembly 1 and outwardly through the outlet pipe 5 and fuel line 6 to the combustion system of the internal combustion engine 4.

Figure 2:
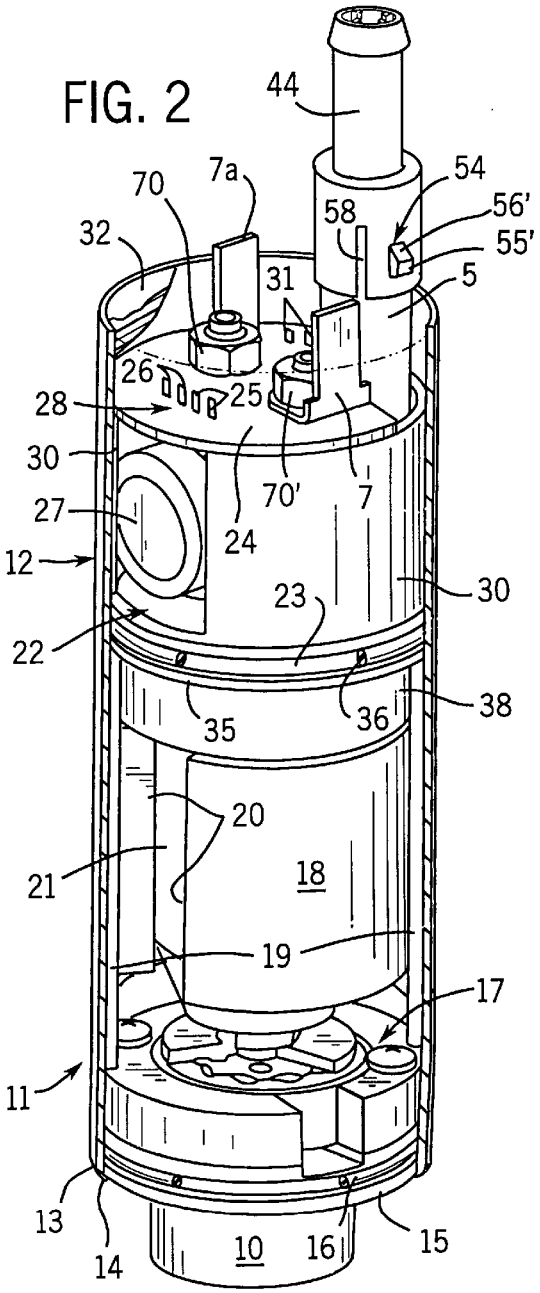
FIG. 2 is a enlarged view of the fuel supply assembly shown in FIG. 1, with parts broken away to illustrate components of the fuel supply assembly.
Figure 3:
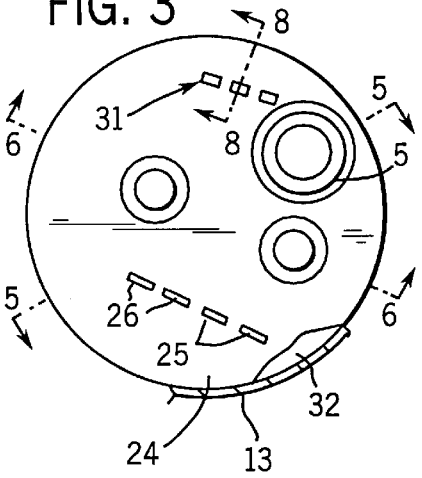
FIG. 3 is a top plan view of the structure shown in FIGS. 1–2.

Referring particularly to FIGS. 2–3, the assembly 1 includes a motor-pump unit 11 and a unitary control unit 12 secured in end-to-end relation within an outer support housing, shown as a cylindrical can 13. Fuel inlet unit 10 includes an inlet plate 15 secured to close the lower end thereof except for an inlet opening into the motor-pump unit 11. The inlet plate 15 is secured in place by a turned-end 14 of the outer housing or can 13 which extends upwardly throughout the motor-pump unit 11 and forms a constant diameter housing within which the various components of the motor-pump unit are housed. An O-ring seal 16 is interposed between the inlet plate 15 and the can 13 to seal the assembly except for an inlet opening in inlet unit 10. A gerotor pump unit 17 is secured within the housing can 13 and supported on the inner surface of the inlet plate 15. A permanent magnet motor 18 is mounted and located within the can immediately above the pump unit 17 and is coupled thereto to drive the pump rotor. Thus, the motor 18 includes an outer motor frame 19 located in abutting engagement with the inner surface of the can 13 and with the lower end abutting the inlet plate 15. A permanent magnet and spacer assembly 20 is secured to the motor frame, with a rotor 21 rotatably mounted therein. The rotor 21 is coupled to drive the gerotor pump unit 17, drawing fuel 3 through inlet unit 10, and pumps the fuel 3 through the motor 18 to the outlet 5.

The motor 18 and the gerotor pump unit 17 may be constructed as more fully disclosed in the parent application, and no further description thereof is deemed necessary. In addition, of course any other pump and motor assembly can be used which provides the necessary pumping capacity and the elongated construction.

Control unit 12 is located immediately above the motor 18 within the can 13 and is interconnected with the motor-pump unit 17.

The present invention is particularly directed to the control unit 12 which is particularly connected as a unitary assembly to one end of a motor-pump unit in the broadest teaching of the present invention, and preferably as the outlet end of a motor-pump unit. The various power connections, the control circuit and control connections and a fuel passageway of the motor-pump unit thus forms a unitary part of the end portion of the fuel supply assembly 1, and in the illustrated embodiment, the upper outlet end with the outlet pipe 5 projecting outwardly for connection to line 6.

Referring particularly to FIGS. 2–6, the control unit 12 includes a supporting tower 22 including a molded plastic body having an integral end frame plate unit 23 secured in abutting relation to the motor frame 19 and spaced from the motor rotor 21. Thus, the inner end of the tower 22 includes a connecting portion connecting the unitary control unit to the motor pump unit. The tower 22 includes the outlet pipe 5 and suitable support for the control components, which generally include a circuit board 24 secured to and forming an outermost end structure of the control unit. The circuit board 24 is secured in spaced relation to the frame plate unit 23, with power connecting terminals 7 and 7*a* secured to and projecting outwardly of circuit board 24. A pressure sensor 27 is located between the frame plate 23 and the circuit board 24. A set of pressure sensing terminals 28 includes a pair of input power leads 25 to the sensor 27 and a pair of output leads 26 establishing a control signal proportional to the output of the sensor. A power transistor 29 (FIGS. 4, 8 and 9) is mounted to an inner cooling collar 30 located in abutting relation to the outer can 13. The cooling collar 30 is formed of copper or other material of high thermoconductivity to provide maximum cooling of the power transistor 29. The power transistor 29 has terminal 31 which extends through the circuit board 24 and are interconnected into a control circuit in accordance with conventional circuit board construction.

A suitable encapsulating material 32, such as epoxy resin, fills the can extension surrounding the control unit 12 to the upper level of the can, including all voids within the tower to seal the control components against the fuel 3 and support the components as a unitary assembly with the motor-pump unit 11.

Figure 4:
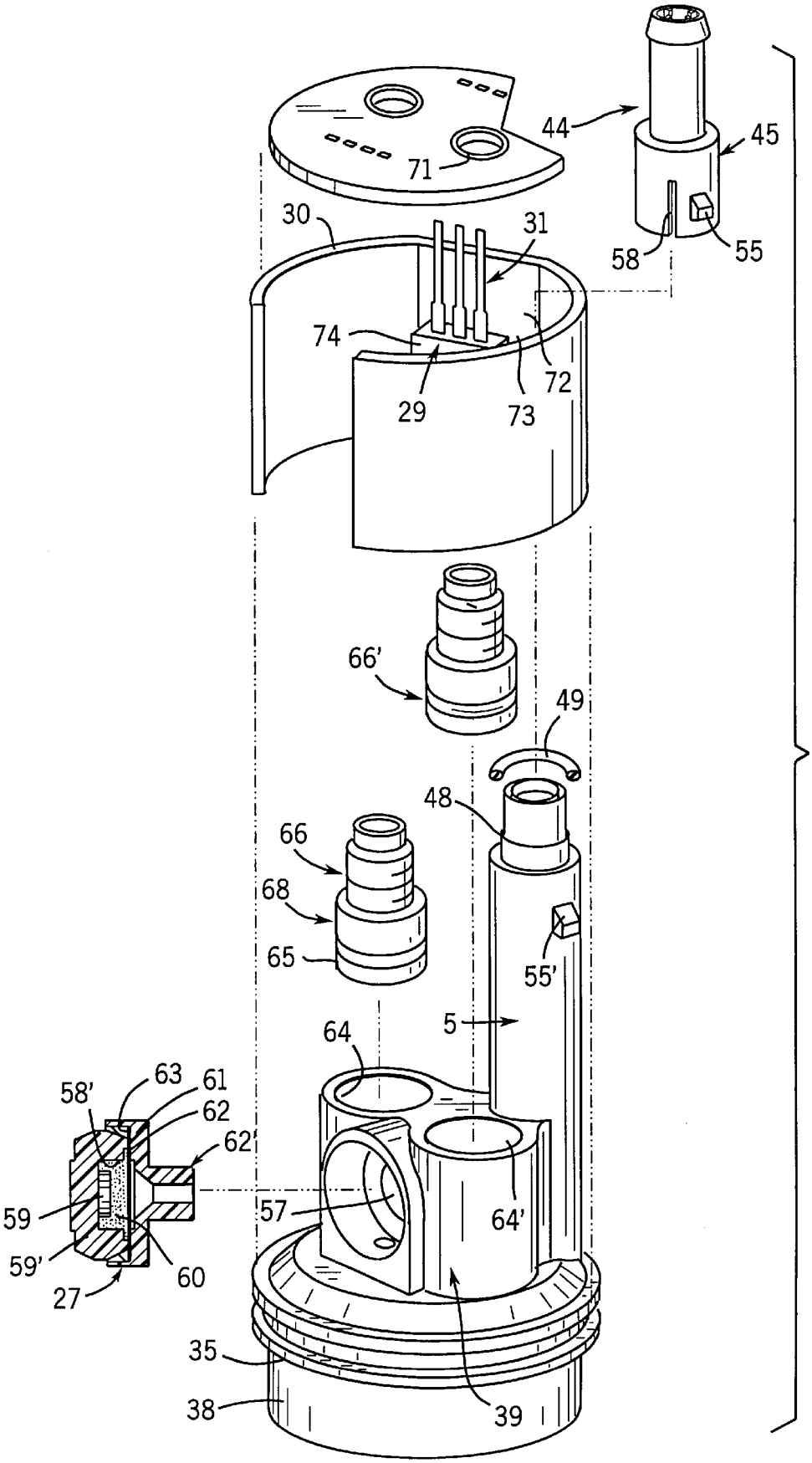
FIG. 4 is an exploded view of the structure shown in FIGS. 1–3.
Figure 7:
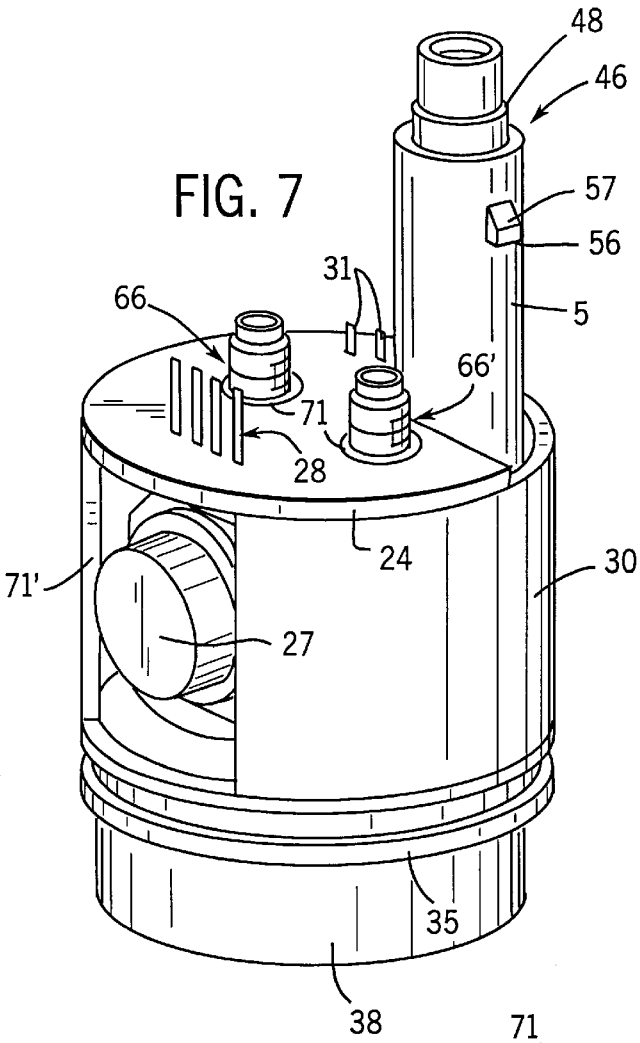
FIG. 7 is a separate perspective view of the control tower assembly shown in FIGS. 1–6.
Figure 6:
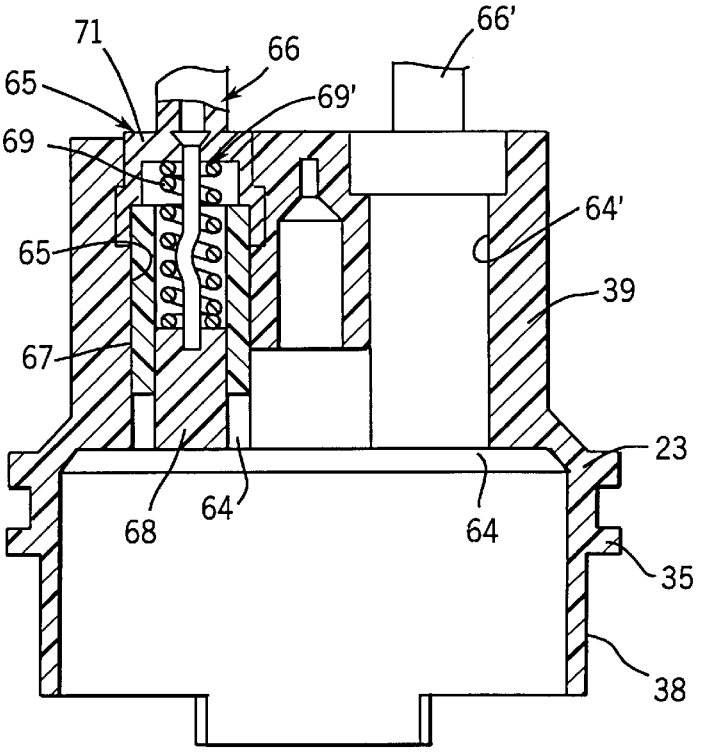
FIG. 6 is a cross-sectional view taken generally on line 6—6 of FIG. 3.

Thus, the tower assembly 22 is a separate self-contained sub-assembly adapted to be assembled, as shown in FIGS. 4, 6 and 7, and then mounted into the outer housing or can 13, with the epoxy resin or other suitable material 32 introduced into and filling of the cavity containing the control and power components.

Figure 5:
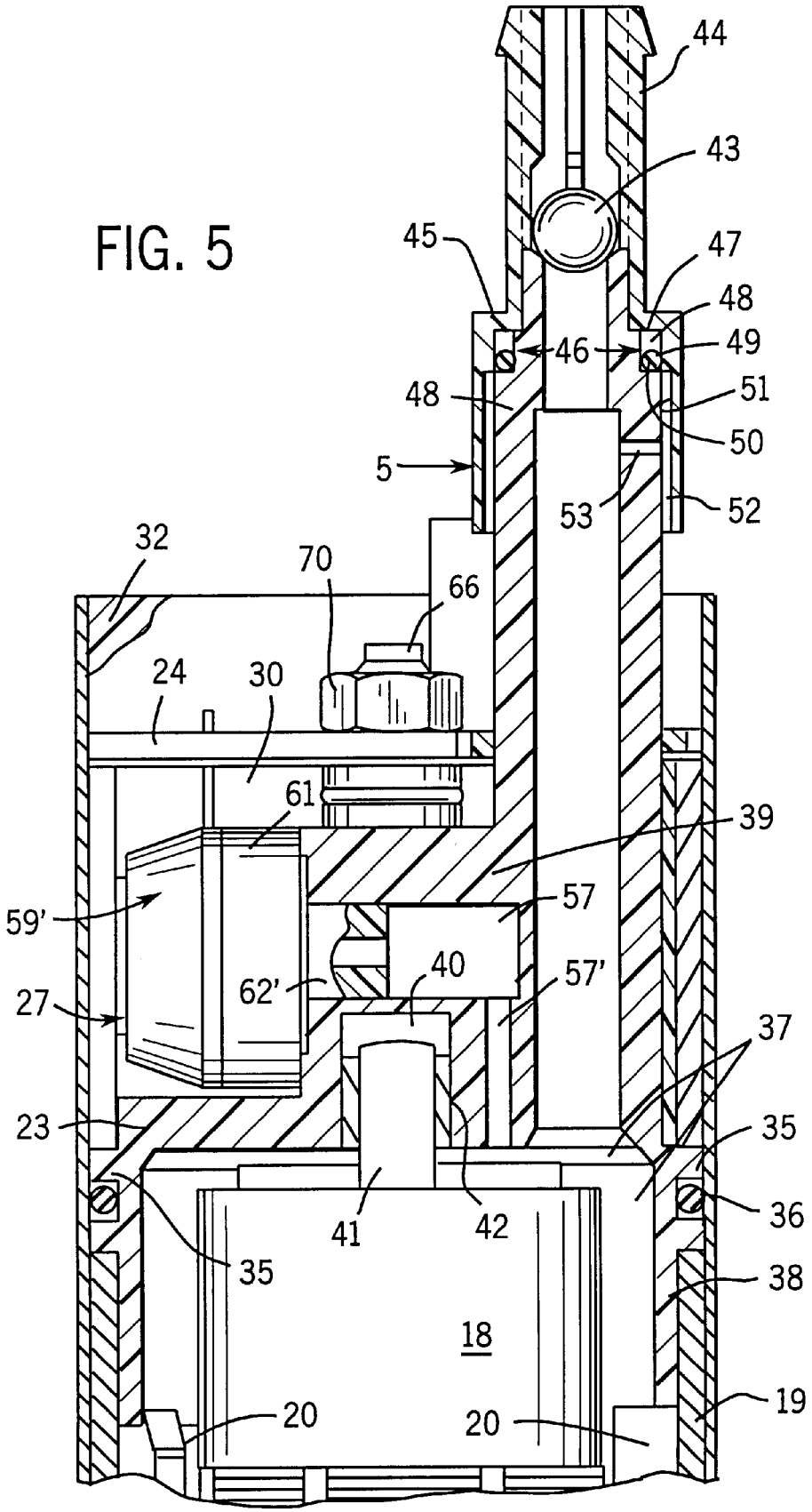
FIG. 5 is a cross-sectional view taken generally on line 5—5 of FIG. 3.

Referring particularly to FIGS. 4–6, the detail of the illustrated embodiment of the invention is more clearly shown. The tower 22 is a molded plastic body member. The tower frame plate 23 includes a sealing edge 35 of a diameter substantially corresponding to the inner diameter of the outer can 13 (FIG. 5). The edge is recessed with an O-ring 36 interposed between the can 13 and the edge such that upon assembly a fluid-tight seal is created about the interface between the control tower 22 and the pumping chamber 37 within the motor-pump unit. The tower 22 includes a tubular projection 38 projecting inwardly into the motor compartment frame 19. The tubular projection 38 terminates adjacent the permanent magnet and spacer assembly 20 of the motor 18 to properly locate the frame plate 23 relative to the motor. An enlarged solid housing or body portion 39 is integrally molded with the end frame plate 23 and projects across the axis or center portion of the motor. A bearing opening 40 is aligned with the axis of the motor and receives the motor shaft 41 to support the adjacent end of the rotor. The bearing opening is shown having a sleeve-type bearing 42 lining the opening to provide a low-friction support of the rotor.

Referring particularly to FIGS. 4 and 5, the outlet pipe 5 is integral formed to one side of the housing portion and extends beyond the enlarged body portion 39, terminating just slightly outwardly of the end can extension. The inlet end of the outlet pipe 5 terminates in communication with the pumping chamber 37 to receive the fuel 3 which flows through the chamber. The outer end of the passageway or pipe 5 includes a check valve 43 to prevent backflow of fuel into the outlet and the motor-pump unit.

The end of pipe 5 is specially formed to receive a coupler 44 for connection to line 6, as follows. Referring to FIGS. 4 and 5, the outer end of the pipe 5 is provided with a double reducing step 45 and is specially shaped to receive and couple to coupler 44. The coupler 44 is a tubular member having a step portion 46 which defines a locating ledge 47 engaging the first pipe step 48 of the pipe 5. An O-ring seal 49 is located in alignment with the second step 50 of the pipe 5 and provides a fluid-tight connection of the coupler to the pipe 5. The coupler 44 projects over the pipe 5 from the O-ring seal 49 with an outer hub 51 spaced in outwardly spaced relation to the pipe 5, thereby defining a continuous gap 52 about the pipe extending inwardly and exiting from the inner end of the hub. A small by-pass port or opening 53 is aligned with the hub 51 and interconnects the outlet passageway of pipe 5 directly to the gap 52. This provides a fuel recycle path for the fuel 3, as broadly disclosed in the parent application, and operates under a low fuel supply state or no fuel supply state to maintain fuel flow and prevent vapor lock and the like.

The coupler 44 is secured in the fixed relation to the pipe 5 to form a sealed extension thereof through a simple snap coupling 54 (FIGS. 1, 2 and 4). Coupler 44 includes diametrically located openings 55, illustrated as generally rectangular openings. The pipe 5 in turn includes oppositely disposed camming projections 55'. Each projection 55' has the outer wall of the projection inclined outwardly from the pipe wall to form a cam wall 56'. The projecting hub portion is made flexible by slots therein such that the hub portion 51 deflects slightly outwardly and pass over the projections 55,, as a result of the cam walls. When the projections 55, move into alignment with the openings 55, the hub contracts and coupler 44 is fixed to the pipe 5, as most clearly shown in FIGS. 1 and 2.

Referring to FIGS. 4 and 5, the body portion 39 projects laterally of the outlet pipe 5, extending over the bearing opening 40. A laterally extended sensor opening 57 is formed in the enlarged body portion and spaced slightly axially outwardly of the bearing opening 40. An axially directed small opening 57' is interconnected between the sensor opening 57 and the interior face of the end frame plate 23 to couple the output pressure within the motor output chamber 37 into the sensor. Thus, the end face of rotor 21 is spaced slightly from the inner face of the end frame plate 23 to form a gap for coupling of the output pressure into the sensor 27, and provide for brush contacts on the rotor.

Referring to FIG. 4, a simplified illustration of a commercial unit 7 modified for application in the present invention is disclosed. Thus, the sensor unit 27 includes a cup-shaped housing 59' having an opened-ended chamber 58'. A pressure sensing die 59 is secured to the base of the chamber 58. A pressure transmitting medium and preferably a gel 60 fills the chamber to the outer opened end. A cap 61 is secured into overlying relation to the housing 58, with a diaphragm 62 abutting the opposed faces of the housing 5 and the cap 69. A pressure port 62' is centrally located in a stem of the cap 61, generally in co-axial alignment with the chamber 58' and the pressure sensing die 59. The diaphragm 62 is formed of a material which is substantially impervious to and attacked from the fuel being pumped. The diaphragm 62 is connected to the housing and cap with a fluid tight connection. In a particularly satisfactory assembly, a stainless steel diaphragm 62 is secured to the abutting faces of the housing and cap through a lazer or brazed connection 63.

The fuel pressure is applied to the diaphragm 62 and the gel 60 transmits the pressure to the sensing die 59 which in turn creates an output signal to the circuit board. The output of the sensing dies 59 provides a calibrated voltage signal proportional to the input pressure established by the fuel pump.

Referring to FIGS. 4 and 6, the enlarged body portion 39 includes a pair of cylindrical openings 64 and 64' on the opposite side of the axis of the motor 18 and adjacent the pipe 5. Each opening 64 and 64' defines a contact brush opening including a similar brush assembly. Each assembly is similar and a brush assembly is shown in opening 64 and described in detail. A similar brush assembly would be mounted in opening 64'.

Referring particularly to FIG. 6, the brush assemblies are identically constructed and embedded within the axial tower brush openings. A cup-shaped contact cap 65 is embedded within a smaller opening in the outer wall of the tower in alignment with the brush opening 64 and includes a portion extended through the wall of the housing to define a terminal plate and post 66 connected to a power terminal 7 (FIGS. 1 and 2) on the circuit board 24 and other appropriate interconnections thereto. The inner enlarged end of the cap 65 is located within the axial brush opening. An insulating brush holder 67 is inserted into the brush opening 64 and projects upwardly into the cap, with side wall slots and projections, not located, to located the holder in place. The brush holder has a central opening shaped to conform to the cross section of a brush 68 which is generally a truncated cross section to hold the brush in place. The contact brush is interconnected by a flexible conductor 69 to the cap, with a coil spring 69' located between the cap base and the opposing brush end and resiliently holds the brush in engagement with the rotor contacts of rotor 18 to supply power thereto. The terminal post 66 extends outwardly and terminates in an outer threaded portion projecting from a flat contact surface to receive a clamp nut 70 (FIGS. 2 and 5).

The circuit board 24 is provided with openings aligned with and telescoped over the terminal 66. Metal contact, shown as a round, metal contact disc 71, (FIGS. 3 and 4) is provided at each opening to provide the circuit connection.

Figure 8:
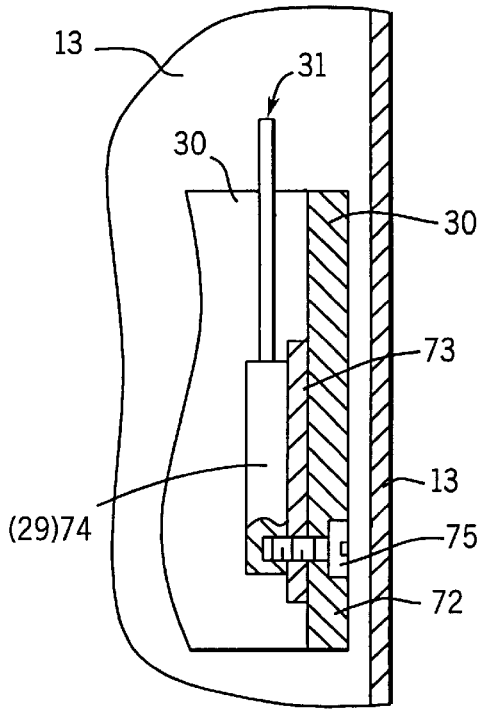
FIG. 8 is a fragmentary sectional view taken generally on line 7—7 of FIG. 3.

As previously disclosed, the cooling collar 30 is interposed between the end plate 23 of the tower unit and the circuit board 24. The circuit board 24 includes openings for the transducer terminals 28 and the solid state switch terminals 31, with soldered connections thereof into the control circuitry interconnected to receive the electrical signal from the transducer, amplify the same and provide a controlled switching of the power transistor 29. As shown in FIGS. 4, 5 and 8, collar 30 is a substantially semicircular cylindrical member which encircles the tower body in abutting engagement with can 13, with an opening aligned with the sensor. The collar has a flat wall 72 located in an open area adjacent the outlet pipe 5. An electrical insulating material 73 coats the inside of flat wall 72. A solid state switch chip 74 forming transistor 29 is firmly secured to the insulated wall 72. For purposes of illustration, a small screw 75 (FIG. 8) secures the chip 74 in place for effective cooling of the switch, with the terminals 31 of transistor 29 extended outwardly of can 13. Clamping nut 70 on the threaded terminals 66 and 66' clamps the circuit board 24 to the edge of the collar 30 (as shown in FIG. 5) to support the circuit board and simultaneously provide power from terminals 7 and 7*a* directly to the motor brush assemblies and to the control circuitry carried by the circuit board 24.

In the illustrated embodiment of the invention (FIG. 2), the power supply terminal 7 is a generally L-shaped member having a base secured abutting the terminal contact disc 71. The supply terminal 7*a* is similarly formed and connected to the board 24 as a common ground through other components of the control circuit to complete the control circuit connections to the power supply to the terminals 67 of the motor 18, the sensor terminals 28 and the transistor terminals 31.

A preferred circuit is more fully disclosed and described in the inventor's co-pending parent application.

In the illustrated prior circuit of the parent application, the positive power line is shown connected in series with a protective diode in series with both the motor connection and with a control circuitry. The diode prevents reverse voltage across the control circuit and the motor. Applicant has found that the direct connection of the power supply to the motor, even with a reverse polarity connection, will not damage the motor. However, such reverse polarity power application to the control circuit will, in fact, damage the circuit. A modified connection provides an improved assembly and minimizes damage to the diode. Referring to FIG. 9, a preferred circuit connection is shown with the positive power terminal 7 connected directly to the positive side of the motor 18 winding. A diode 76 is interconnected between the positive contact disc 71 and thereby the sensing and control circuit 77 on board 24 to supply power thereto. A common return 78 is connected to the terminal 7*a* and in common with the return side of the transistor 29 which is connected in series with the motor 18 and with the sensing and control circuit 77.

A further embodiment of the invention with the tower structure is illustrated in FIGS. 10 and 11. Generally, the structure follows that of the previous embodiment with a pressure sensor assembly reoriented and arranged extending substantially axially of the fuel pump unit. The elements of the second embodiment corresponding to the previous are correspondingly numbered with the sensor assembly separately numbered for clearly describing the difference. Referring particularly to FIG. 10, the outlet end of the fuel pump unit 1 is illustrated with parts broken away and sectioned to illustrate a pressure transducer assembly 80 and its orientation within the tower 22 and the associated connections to the circuit board 24. In particular, the transducer assembly 80 is secured within the tower 22, which is secured within the outer can 13, substantially as in the first embodiment. The base structure of the tower 22 has a pressure opening 81 which extends axially from the outer face of the rotor 21 and the motor chamber, and transmits a pressure signal in accordance with the output pressure of the fuel supply to the transducer assembly 80. The transducer assembly 80 includes a sensor unit 82 secured within the tower in axial alignment with the pressure opening 81 and with a sensing member abutting the pressure opening 81. The sensor unit 82 is preferably constructed as the previously disclosed unit in FIG. 4 and includes a cup-shaped housing 84 is filled with a pressure transmitting medium such as a gel, silcone oil or the like, not shown. The outer face is closed by a stainless steel diaphragm 87.

The die housing 88 is secured to the outer end of the housing 84 with a die 85 within housing 88. The pressure sensing medium transmits the pressure on the diaphragm 87 to the die. Sensor terminals 89 are arranged in a small circuit board 90, with the terminals 89 laterally spaced and projecting to the opposite sides of the terminal portion. The one end of the terminals 89 extend to and connect to die 85. The terminals 89 project axially through the main circuit board 24 and are interconnected through the main circuit board 24 into the pump operating circuit. The flexible stainless steel diaphragm 87 is again deflected by the output pressure of the fuel pump unit 1 and provides a pressure related output as in the first embodiment.

The tower has the enlarged portion 39 including a curved central portion within which the sensor housing 84 is located. The exterior tower sidewall adjacent the sensor housing is located in abutting engagement with the outer shell or can 13.

In the embodiment of FIGS. 10 and 11, a generally U-shaped heat sink collar 91 having a circumferential length of approximately 180° is provided and located immediately inside of the outer can. The collar 91 supports the power transistor, not shown, secured for maximum heat transfer to the heat sink collar.

As in the first embodiment, the collar extends to the opposite side of the transistor about the arrangement and results in a similar plurality of cavities 92 between the housing and the tower unit, which is filled with epoxy or other suitable material for securely interconnecting of the components into a single integrated unit. The circuit board is secured overlying the upper face of the assembly substantially as in the first embodiment.

In summary, the present invention includes an assembly of components for the control and power supply system which is packaged as a unitary assembly secured to the end of the motor-pump unit. In the illustrated embodiment of the invention, it is shown in a preferred construction including a tower assembly having a molded outlet passage and frame end of the motor-pump unit, as well as control components and the power connection to the motor. The tower assembly could be applied to the inlet end of the motor-pump unit assembly, and formed as a part of the inlet unit, appropriately configured to receive and mount the several components in any desired manner, and preferably similar to that illustrated for the outlet side of the motor-pump. Attachment at the inlet end, however, would require special construction to provide a recycle flow path at or adjacent the upper end of the fuel supply assembly to maintain recycle flow and prevent vapor lock and the like.

Various modifications can be obviously made. For example, the body member may include individual components, such as a separate motor end frame. The outlet passageway can be formed as a separate conduit member otherwise interconnected with the body member. Similarly, the other body portions can be formed as separate elements interconnected to each other to form a unitary assembly, and in particular, compact unitary control and supply fuel passageway assembly adapted to be interconnected to an end of a motor-pump.

In summary, the illustrated embodiments of the invention with the stacked arrangement of the unitary assembly including both the control circuitry, the sensing unit and fuel flow passageway provides a particularly satisfactory assembly system for maintaining cost effective manufacture and maintenance while maintaining an optimal level of operation and functioning of the fuel supply system.

Various modes of carrying out the invention are contemplated as being within the scope of the following claims particularly pointing out and distinctly claiming the subject matter which is regarded as the invention.

We claim:

1. A fuel pump assembly for in-tank mounting for supplying fuel from a fuel tank to an internal combustion engine under a controllable pressure, comprising a motor-pump unit including an elongated motor and a pump unit secured to one end of said motor and adapted to pump fuel from the fuel tank, said motor-pump unit having a first end and a second end, an inlet unit secured to said first end of said motor-pump unit and extending outwardly thereof and closing the first end of said motor-pump unit, said inlet unit having a fuel inlet for entry of fuel into said motor-pump unit, a control tower unit secured to said second end of the said motor-pump unit and closing the second end of said motor-pump unit, and said control tower unit including an outlet passageway connected to said second end of said motor-pump unit for delivery of fuel therefrom and a control system including a pressure responsive unit and a circuit control unit connected to control the power supplied to said motor.

2. The fuel pump assembly of claim 1 including an outer can enclosing said motor-pump unit, said inlet unit and said control tower unit.

3. The fuel pump assembly of claim 2 including an encapsulating and supporting material filling said can about said control tower unit.

4. The fuel pump assembly of claim 2 wherein said control tower unit includes a body member having a closure plate secured abutting the motor-pump unit and having a peripheral seal to said outer can, said outlet passageway being located in said body member and extending axially outwardly from the motor-pump unit to the exterior of said can, said body member including a sensing passageway connected to said second end of said motor-pump unit configured with a fuel output, said pressure responsive unit including a pressure sensor secured to said body member within said can and having an inlet connected to said sensing passageway, said control system including a control circuit board mounted within said can and secured to said body member, said circuit board having supply terminals projecting outwardly and exposed at the outer end of said can, a cooling member interconnected to the interior of said can, a power switch unit located within said tower unit and including a solid state switch unit secured to said cooling member, said circuit board having circuit means interconnected to said pressure sensor and to said solid state switch and to said power supply terminals and to said motor to establish energization of said motor in accordance with the output pressure of said motor-pump unit and establishing an essentially controlled constant pressure of the fuel supply to said engine.

5. The fuel pump assembly of claim 4 including an encapsulating material filling said can about said tower unit to enclose said components of said tower unit.

6. The fuel pump assembly of claim 4 wherein said can has an essentially constant diameter and defining an elongated construction for mounting within the fuel tank.

7. The fuel pump assembly of claim 1 wherein said tower includes an axially extended sensing opening generally parallel to the extension of the tower, said pressure responsive unit including a pressure sensor having a housing located within said opening and includes a sensing diaphragm member closing said outer end of said opening and a pressure sensing die element in said housing, said diaphragm being formed of a material non-reactive and non-destructive with respect to said fuel, said sensor having a chamber with a pressure responsive electrical signal source secured within said chamber, an hydraulic gel filling said chamber and transmitting pressure on said diaphragm to said die element and thereby generating a signal related to the pressure on said diaphragm, said sensor terminals connected to said pressure sensing die element.

8. The fuel pump assembly of claim 7 wherein said diameter opening and said diaphragm being fixedly secured to said chamber in a fluid type relationship thereto.

9. The fuel pump assembly of claim 7 wherein said opening and sensor are located radially offset from the axis of the tower.

10. The fuel pump assembly of claim 7 wherein said diaphragm is a flexible metal plate.

11. The fuel pump assembly of claim 10 wherein said plate is a stainless steel plate.

12. A fuel pump assembly for in-tank mounting for supplying fuel from a fuel tank to an internal combustion engine under a controllable pressure, comprising an elongated motor-pump unit adapted to pump fuel from the fuel tank, a control tower unit secured to one end of said motor-pump, and said control tower unit including an outlet passageway for delivery of fuel therefrom and a control system including a pressure responsive unit and a circuit control unit connected to control the power supplied to said motor, and said motor-pump unit and said control tower unit being enclosed within a sealed enclosure including a fuel inlet and a fuel outlet.

13. The fuel pump assembly of claim 12 wherein said enclosure includes an outer can enclosing said motor-pump unit, and said control tower unit, and an encapsulating and supporting material filling said can about said control tower unit.

14. The fuel pump assembly of claim 13 wherein said control tower unit includes a body member having a closure plate secured abutting the motor-pump unit and having a peripheral seal to said outer can, said motor-pump unit including an outlet at said closure plate, said outlet passageway in said body member extending axially outwardly from said outlet of the motor-pump unit to the exterior of said can, said body member including a sensing passageway connected to the outlet of said closure plate of said motor-pump unit, said pressure responsive unit includes a pressure sensor secured to said body member within said can, said sensor having a sensing chamber with a pressure inlet connected to said sensing passageway, a sensing die located in said sensing chamber and responsive to pressure to establish a related output signal, a diaphragm closing said sensing inlet, a gel filling said sensing chamber, said control unit including a control circuit board mounted within said can and secured to said body member, and said circuit board having power supply terminals projecting outwardly and exposed at the outer end of said can and having a control circuit connected to supply power to said motor-pump unit in accordance with said output signal.

15. The fuel pump assembly of claim 14 wherein said control circuit includes a solid state switch unit secured to a cooling member interconnected to the interior of said can, said circuit board having circuit means interconnected to said pressure sensor and to said solid state switch and to said power supply terminals and to said motor to establish energization of said motor in accordance with said output signal and establishing an essentially controlled constant pressure of the fuel supply to said engine.

16. The fuel pump assembly of claim 14 wherein said sensing passageway extends longitudinally of said can from said motor-pump unit, said sensing die having terminals extending from said pressure sensor longitudinally of said can through said circuit board for connection to said power terminals and said motor.

17. The fuel pump assembly of claim 13 wherein said can has an essentially constant diameter and defining an elongated tubular construction for mounting within the fuel tank.

18. The fuel pump assembly of claim 17 wherein said motor-pump unit is secured in one end of said can and said tower unit is secured in the opposite end of said can, said tower unit including a body member closing the end of the motor-pump unit having said sensing passage and outlet passageway.

19. A fuel pump apparatus for pumping of fuel from a fuel tank under a controllable pressure, comprising an elongated motor-pump unit including a motor and a pump unit secured to one end of said motor, an outer can having a substantially constant diameter enclosing said motor-pump unit and projecting axially therefrom and defining a control chamber immediately adjacent one end of said motor-pump unit, a control assembly mounted within said control chamber and including a support body having a closure portion of a diameter essentially corresponding to the internal diameter of said can adjacent one end of said motor-pump unit and sealing the end of the motor-pump unit, a pressure sensing unit and a control circuit mounted to said support body, said control circuit connected to said motor-pump unit and to said pressure sensing unit and responsive to said pressure sensing unit to provide controlled power to said motor-pump unit for establishing a controlled flow of fuel to the engine, said support body including an output passageway extending outwardly of said can for supplying of fuel therefrom.

20. The apparatus of claim 19 including a sealing and supporting compound filling of said control chamber to prevent entrance of fuel into said control chamber.

21. The apparatus of claim 19 wherein said support body is a molded plastic block having a circular plate abutting said motor-pump unit and sealed to said can by an O-ring seal, said output passageway formed in said block and projecting outwardly of said can and said control chamber and located adjacent to said can, said body having an enlarged body portion integral with the plate and said passageway and extending laterally across said control chamber, said circular plate and body portion having a bearing passageway aligned with the axis of said motor, said motor-pump unit having a supporting rotating shaft extended into said bearing opening and rotatably supported therein, said body portion including a sensing passageway communicating with said outlet and an axially extended opening connected to said sensing passageway, said pressure sensing unit secured within said axially extended opening and including an axially extended inlet port for sensing of the output pressure, said control circuit including a solid state switch chip, a cooling plate member in the form of a curved plate, said curved plate being located in abutting engagement with said can, said curved plate having a flat wall portion, an insulating material covering said flat wall portion, said solid state switch chip being secured in firm abutting engagement to said flat wall with the insulating material interposed therebetween, said insulating material and said cooling plate being constructed of a high thermal conductivity material for optimum cooling of said solid state switch chip, said curved cooling plate being located abutting said closure plate and projecting axially outwardly thereof about said body, said body having spaced contact openings extending axially through the body and said closure plate, contact units mounted within said contact openings and coupled to said motor at the interior of said closure plate for connection to said motor, contact posts secured in said contact openings coupled to said contact units and including outwardly projected contact posts having an outer threaded terminal connector, said circuit board including openings aligned with said contact opening and secured to said body with said contact posts projecting outwardly through said circuit board openings for receiving of clamping devices for clamping of said circuit board in abutting engagement with said posts and said outer cooling plate, said circuit board having a single set of supply power terminals projecting outwardly from said board and the open end of said can, and a sealing compound filling said control chamber to fully encapsulate the control chamber with said outlet passageway and said power terminals projecting outwardly thereof.

22. A motor-pump apparatus for pumping of fuel from a fuel tank under a controllable pressure, comprising an elongated motor-pump unit having an output, a unitary control unit abutting one end of said motor-pump unit, an attachment unit securing said unitary control unit to said one end of the motor-pump unit and extending outwardly therefrom, said unitary control unit including an outlet pipe extending through the control unit and connected to the output of the motor-pump unit, said unitary control unit having input power terminals and a pressure control unit and an electric circuit operable to control the motor-pump unit for pumping of fuel from the fuel tank under a controllable pressure, and said attachment unit including an outer enclosure having a substantially constant diameter enclosing said motor-pump unit and said unitary control unit to form an elongated controlled fuel flow assembly, wherein said pressure control unit includes a pressure sensing unit, a solid state power switch, a control circuit board including a control circuit connecting said switch to said motor and signal processing circuitry connected to and responsive to said pressure sensing unit and connected to turn said switch on and off to provide control power to said motor-pump unit.

23. A motor-pump apparatus for pumping of fuel from a fuel tank under a controllable pressure, comprising an elongated motor-pump unit having an output, a unitary control unit abutting one end of said motor-pump unit, an attachment unit securing said unitary control unit to said one end of the motor-pump unit and extending outwardly therefrom, said unitary control unit including an outlet pipe extending through the control unit and connected to the output of the motor-pump unit, said unitary control unit having input power terminals and a pressure control unit and an electric circuit operable to control the motor-pump unit for pumping of fuel from the fuel tank under a controllable pressure, and said motor-pump unit including an outer motor frame, said unitary control unit including a plastic body member having a wall at said one end extended into and secured to said motor frame and forming a motor end frame of said motor.

* * * * *

UNITED STATES PATENT AND TRADEMARK OFFICE

CERTIFICATE OF CORRECTION

PATENT NO. : 5,961,293

DATED : October 5, 1999

INVENTOR(S) : ROBERT T. CLEMMONS ET AL

It is certified that error appears in the above-indentified patent and that said Letters Patent is hereby corrected as shown below:

Title page, item:

[54] Title: Delete "IN-TAKE" and substitute therefor -- IN-TANK --;

[56] References: Insert -- Motorola Linear/Interface Devices Specification And Applications Information --.

Signed and Sealed this

Seventeenth Day of October, 2000

*Attest:*

Q. TODD DICKINSON

*Attesting Officer*

*Director of Patents and Trademarks*